US011104160B2

(12) United States Patent
Paker et al.

(10) Patent No.: US 11,104,160 B2
(45) Date of Patent: Aug. 31, 2021

(54) LATERAL ADJUSTMENT OF PRINT SUBSTRATE BASED ON A CAMERA IMAGE

(71) Applicant: HEWLETT-PACKARD DEVELOPMENT COMPANY, L.P., Spring, TX (US)

(72) Inventors: Alexander Paker, Ness Ziona (IL); Jonathan Nir, Ness Ziona (IL); Hagay Shkalim, Ness Ziona (IL); Eitan Kichli, Ness Ziona (IL); Vladimir Feygelman, Ness Ziona (IL); Shraga Friedman, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/607,195

(22) PCT Filed: Dec. 14, 2017

(86) PCT No.: PCT/US2017/066344
§ 371 (c)(1),
(2) Date: Oct. 22, 2019

(87) PCT Pub. No.: WO2019/117909
PCT Pub. Date: Jun. 20, 2019

(65) Prior Publication Data

US 2020/0376860 A1 Dec. 3, 2020

(51) Int. Cl.

| | |
|---|---|
| ***B41J 11/00*** | (2006.01) |
| ***B41J 11/42*** | (2006.01) |
| ***B41J 13/32*** | (2006.01) |
| *B41J 2/045* | (2006.01) |

(52) U.S. Cl.
CPC ..... *B41J 11/0095* (2013.01); *B41J 11/0055* (2013.01); *B41J 11/42* (2013.01); *B41J 13/32* (2013.01); *B41J 2/04505* (2013.01)

(58) Field of Classification Search
CPC ..... B41J 11/0095; B41J 11/0055; B41J 11/42; B41J 13/32; B41J 2/04505
See application file for complete search history.

(56) References Cited

U.S. PATENT DOCUMENTS

| | | | | |
|---|---|---|---|---|
| 4,380,331 A | | 4/1983 | Fischer | |
| 5,140,340 A | | 8/1992 | Stephenson | |
| 5,219,159 A | | 6/1993 | Malachowski | |
| 5,697,609 A | | 12/1997 | Williams et al. | |
| 5,739,913 A | * | 4/1998 | Wallace | B65H 9/18 356/401 |

(Continued)

OTHER PUBLICATIONS

Xerox® Color 800/1000 Presses High definition image quality. Fast. Vibrant. Flexible, Apr. 20, 2010, https://www.xerox.com/digital-printing/latest/X80BR-01U.pdf, 16 pages.

*Primary Examiner* — Henok D Legesse
(74) *Attorney, Agent, or Firm* — Trop Pruner & Hu PC

(57) ABSTRACT

A printing device is provided comprising a camera to capture an image of at least a portion of a print substrate; a controller to determine a location of a portion of a side edge of the substrate from the image to determine a distance of the print substrate from a predetermined location; and adjustment apparatus to adjust the entire substrate laterally, relative to the direction of transport of the substrate, based on the determined location.

20 Claims, 11 Drawing Sheets

(56) References Cited

U.S. PATENT DOCUMENTS

| | | | | |
|---|---|---|---|---|
| 6,137,989 | A | 10/2000 | Quesnel | |
| 6,305,856 | B1 * | 10/2001 | Miyazaki | B41J 11/008 400/120.01 |
| 6,817,609 | B2 | 11/2004 | Halvonik et al. | |
| 7,914,001 | B2 | 3/2011 | Herrmann | |
| 8,308,158 | B2 | 11/2012 | Hirota | |
| 9,315,350 | B2 | 4/2016 | Joseph et al. | |
| 9,348,291 | B2 | 5/2016 | Yamamoto | |
| 2004/0139403 | A1 | 7/2004 | Yakubov et al. | |
| 2006/0285903 | A1 * | 12/2006 | Yamane | G03G 15/6567 399/394 |
| 2008/0240820 | A1 | 10/2008 | Dejong | |
| 2012/0256995 | A1 | 10/2012 | Holzer et al. | |
| 2015/0138292 | A1 | 5/2015 | Jones | |
| 2018/0081316 | A1 * | 3/2018 | Geshi | G03G 15/6511 |

* cited by examiner

LATERAL ADJUSTMENT OF PRINT SUBSTRATE BASED ON A CAMERA IMAGE

BACKGROUND

Printing systems can be designed in such a way that the positioning of print substrates are adjusted to try to ensure that, when printed, the print appears in the correct location on the print substrate. The print substrate may be cut before or after it is printed upon. For example, the print substrate may be a web when printed upon and then subsequently cut. Alternatively, the print substrate may be cut into a sheet before being printed upon. After printing, further cutting of the sheet may be carried out to create a final product.

BRIEF INTRODUCTION OF THE DRAWINGS

Figure 1:
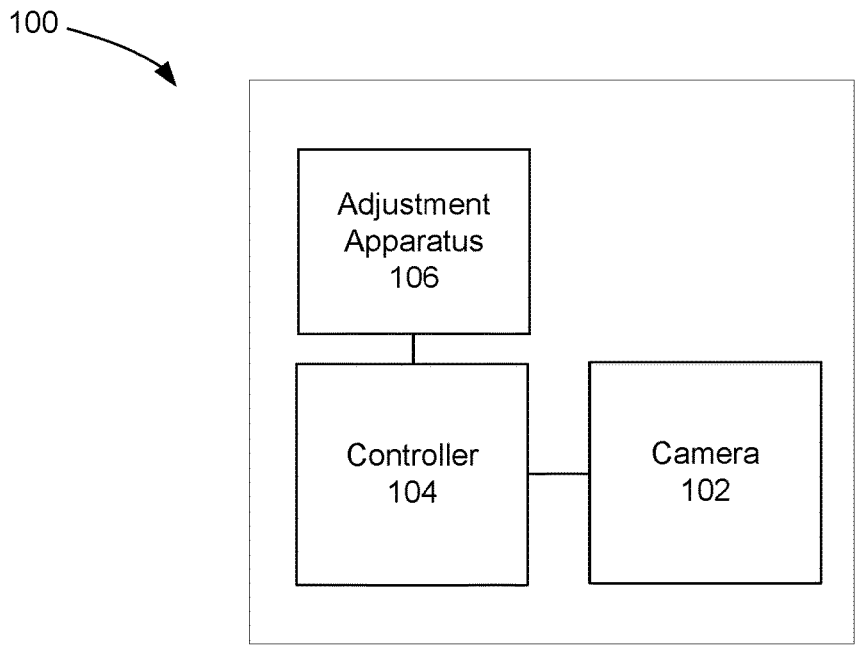
FIG. 1 is a schematic diagram illustrating an example apparatus for adjusting the location of a print substrate.
Figure 2:
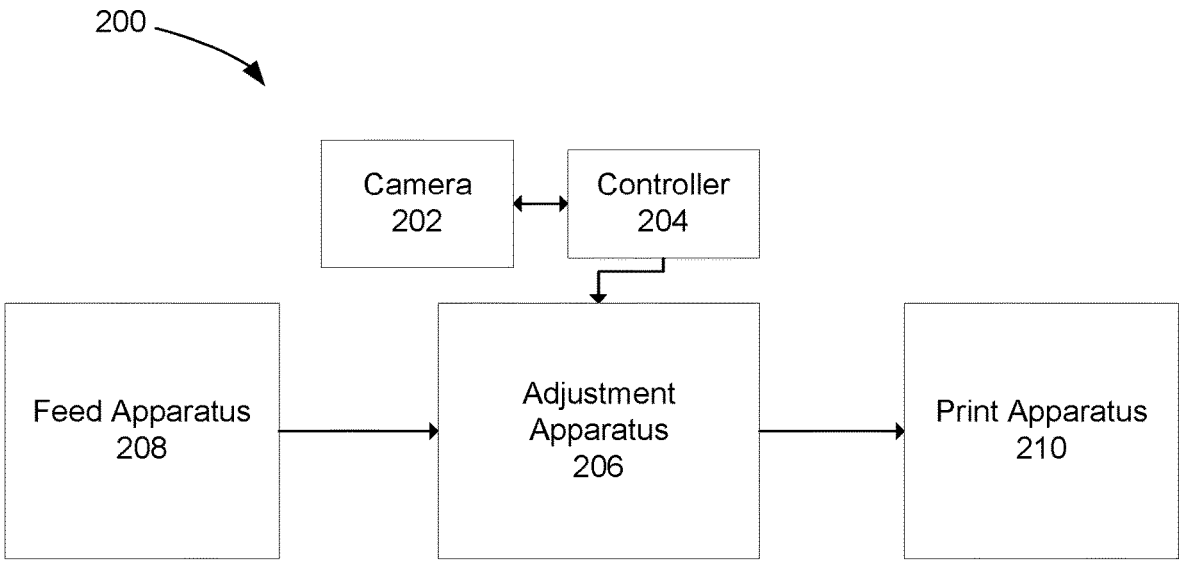
FIG. 2 is a schematic diagram illustrating another example apparatus for adjusting the location of a print substrate.
Figure 3A:
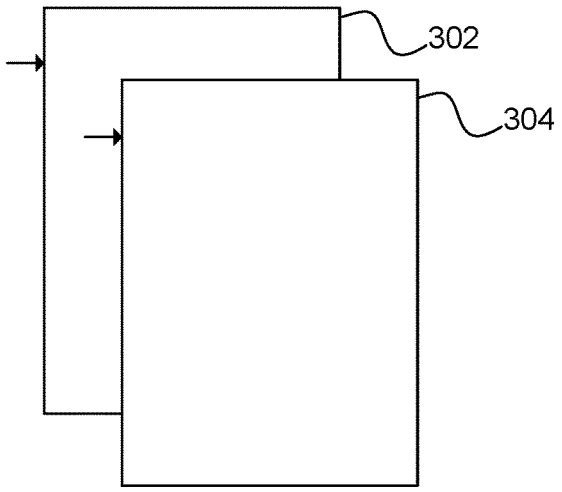
Figure 3B:
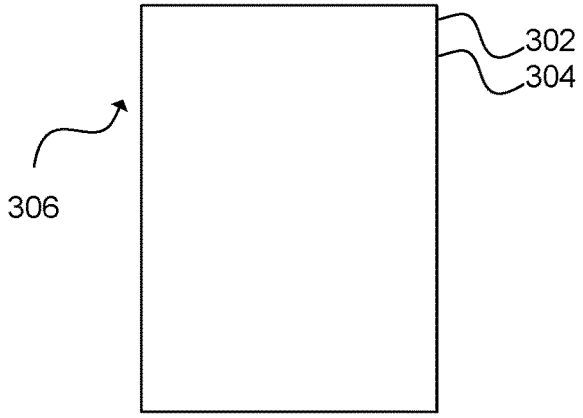
Figure 4:
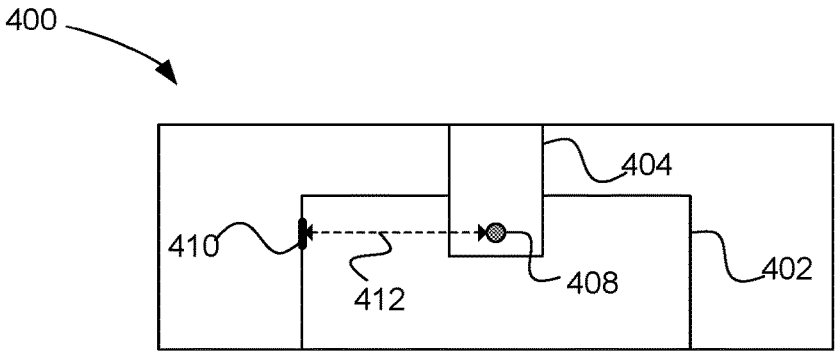
Figure 5A:
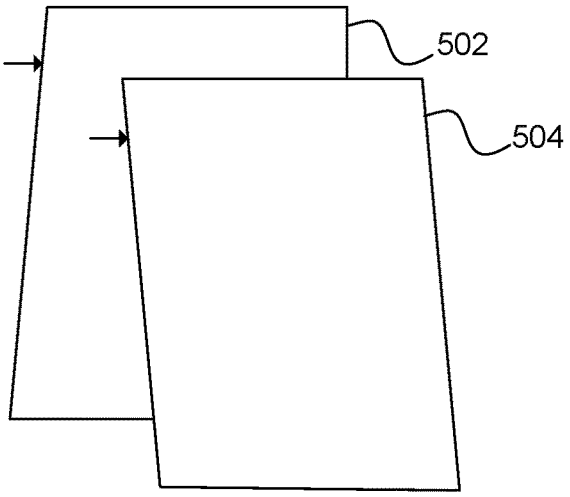
Figure 5B:
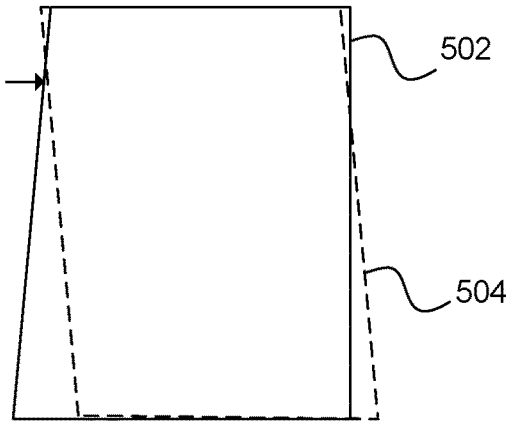
Figure 5C:
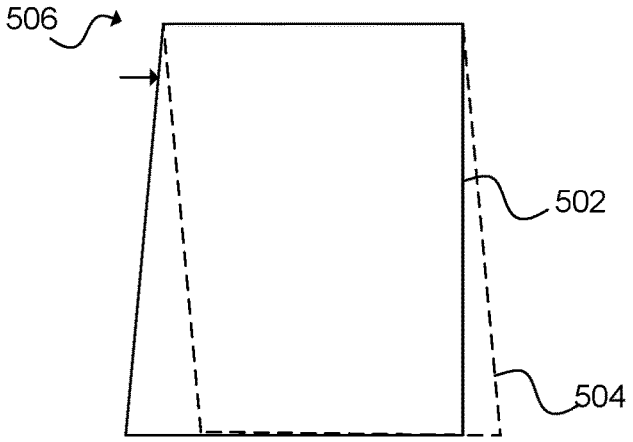
Figure 6:
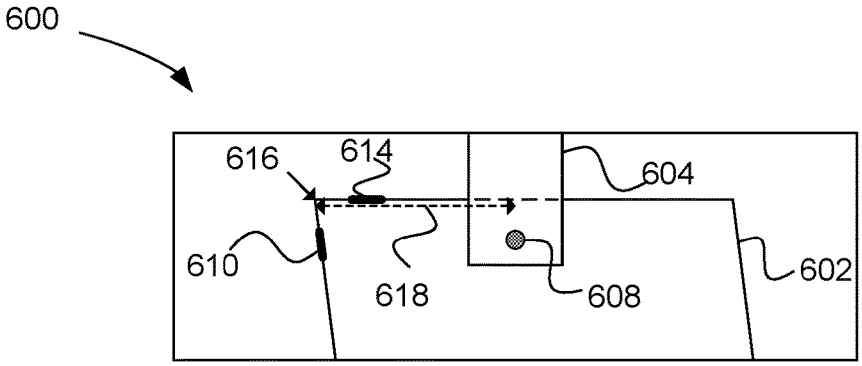
Figure 7:
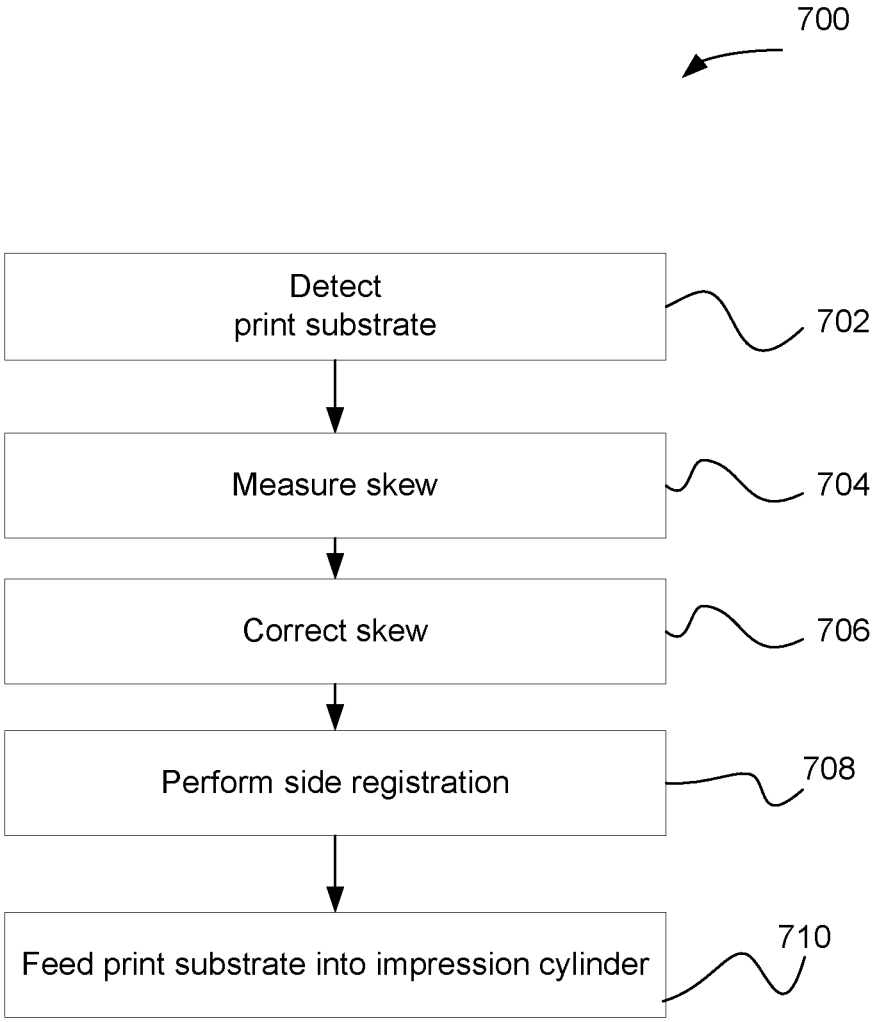
Figure 9:
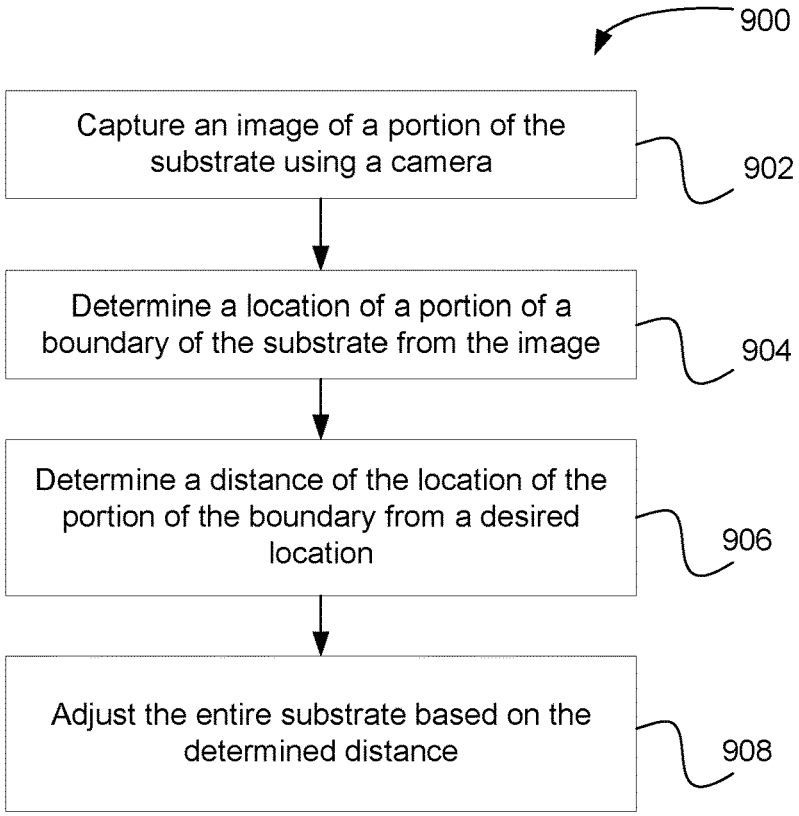
Figure 10:
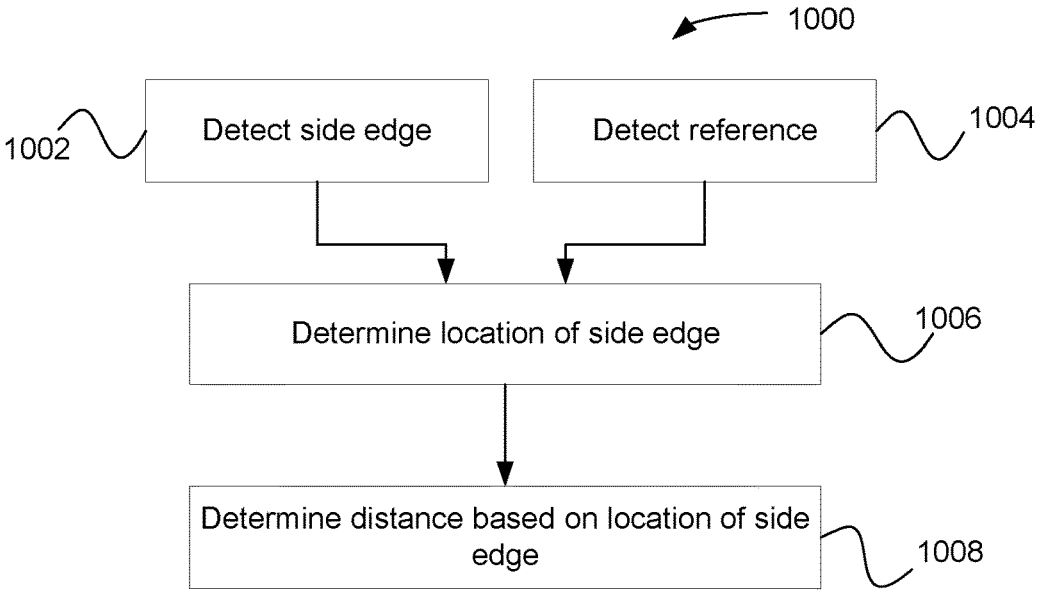
Figure 11:
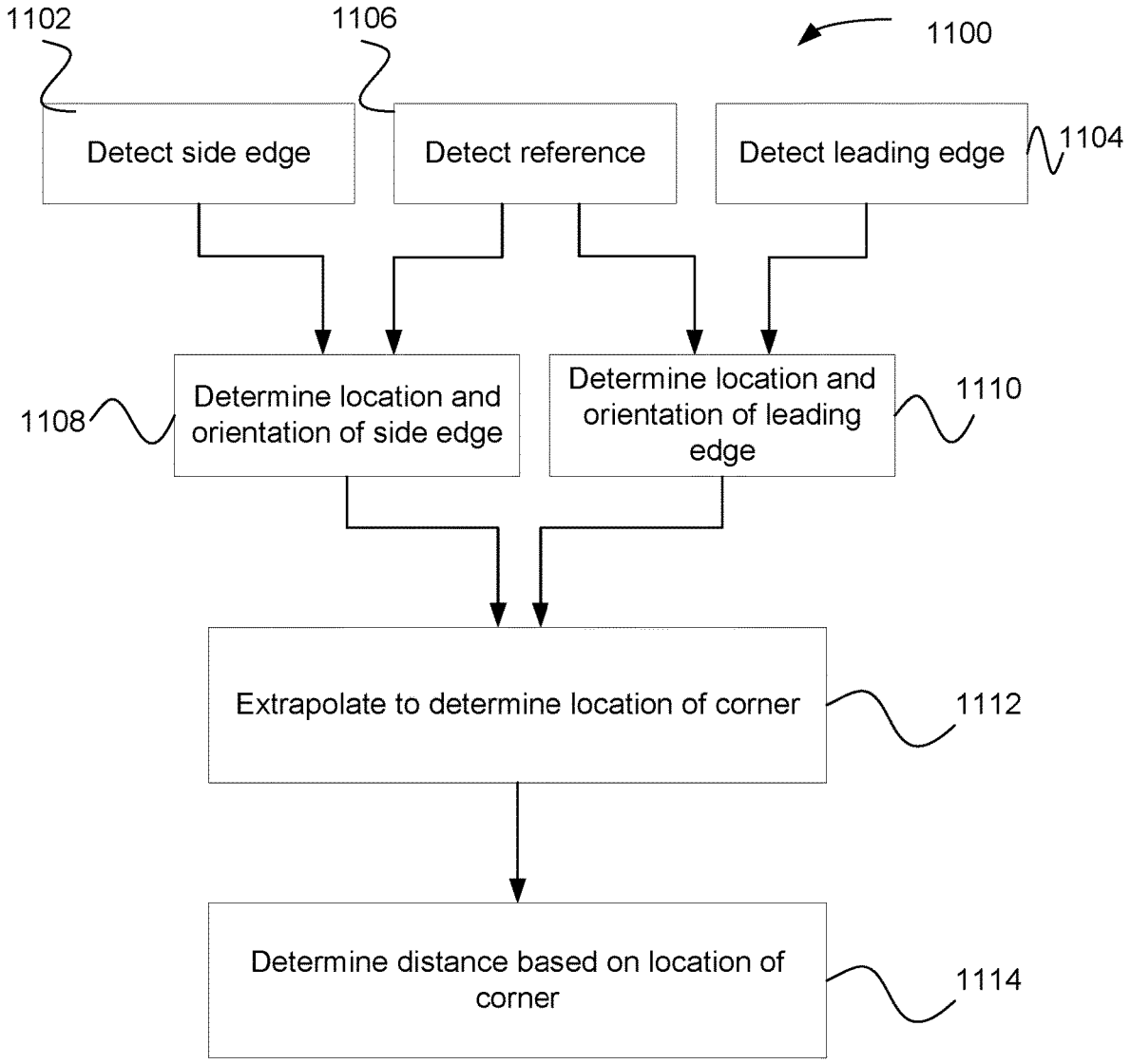
Figure 12:
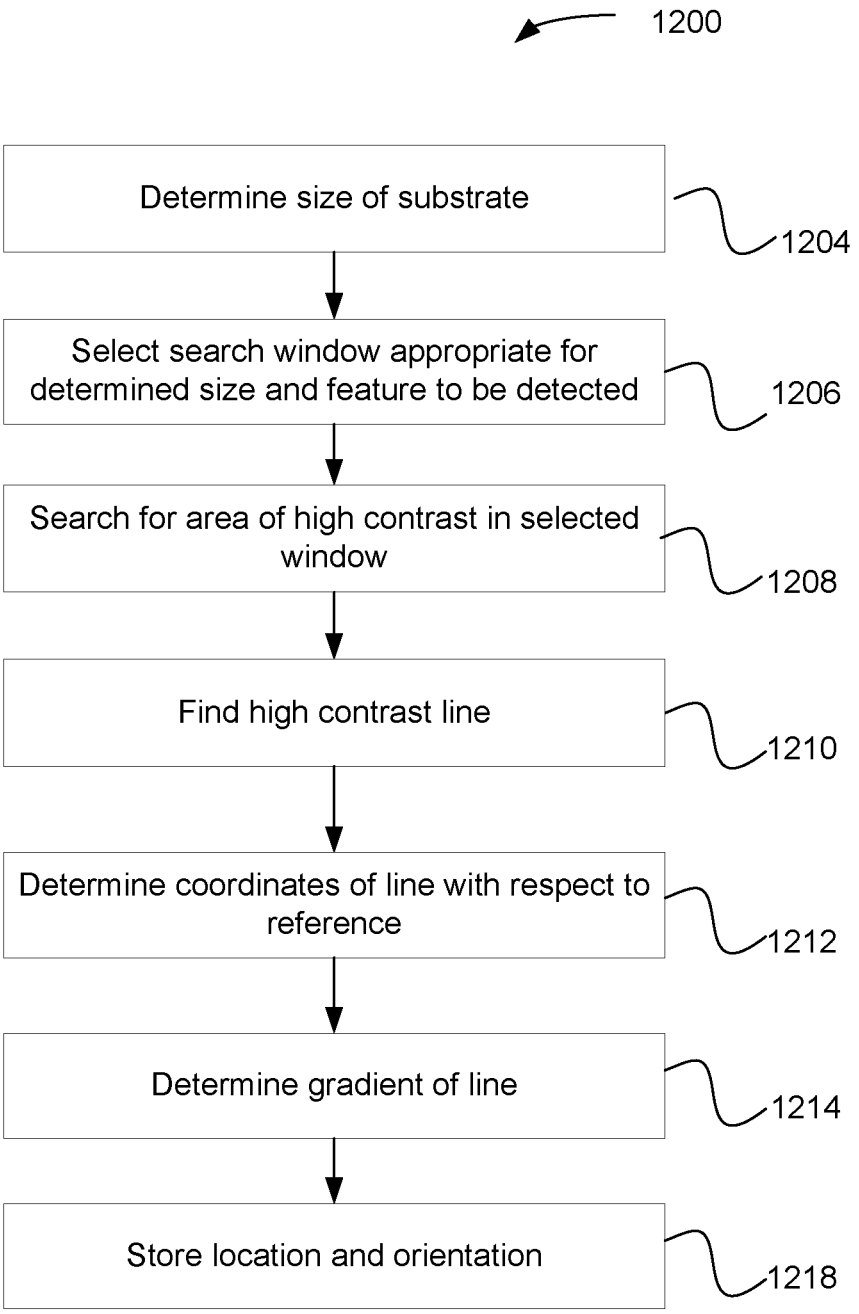
Figure 13A:
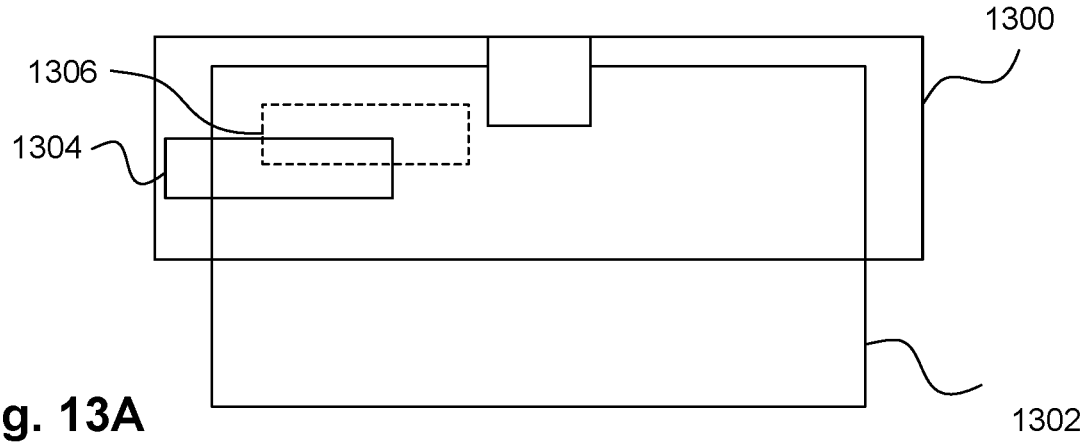
Figure 13B:
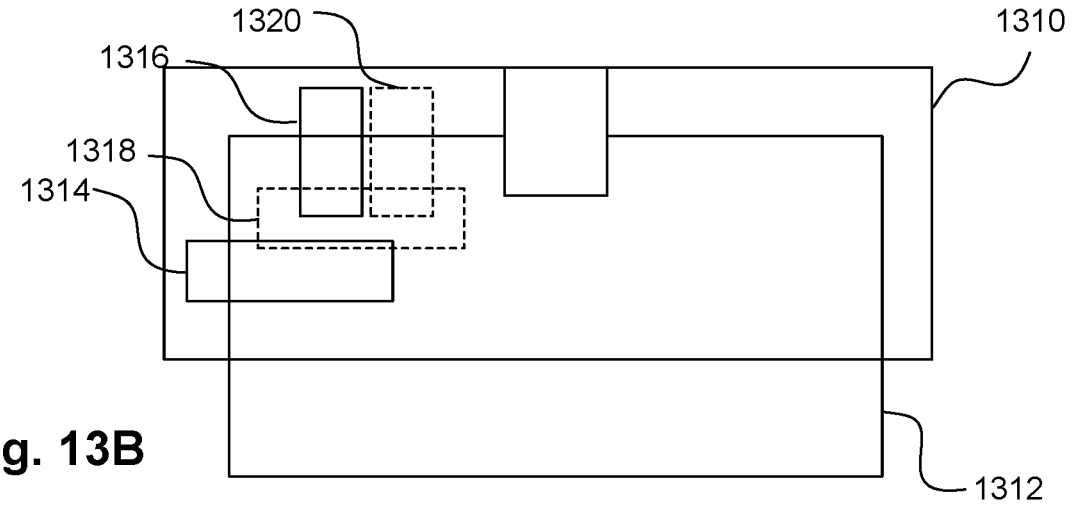
Figure 13C:
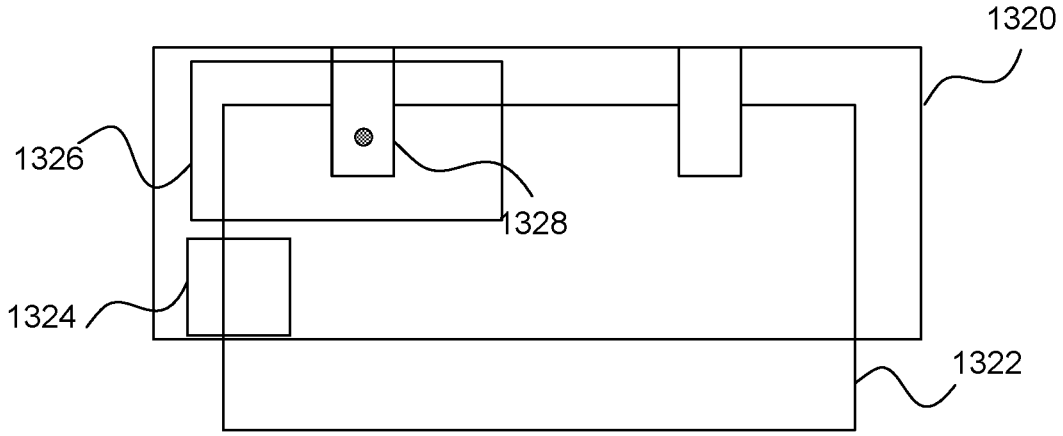
Figure 14:
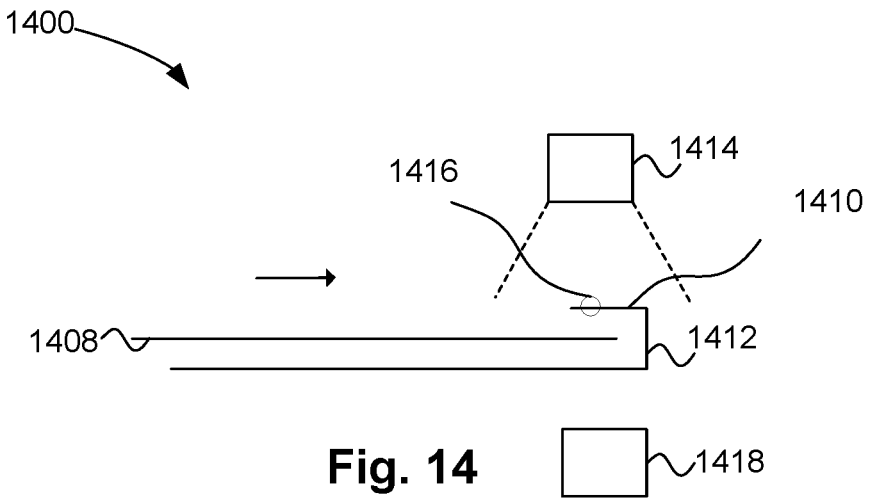
Figure 15:
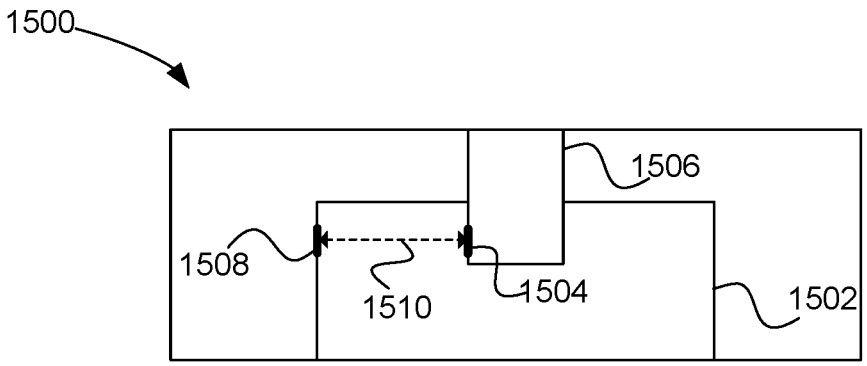
Figure 16:
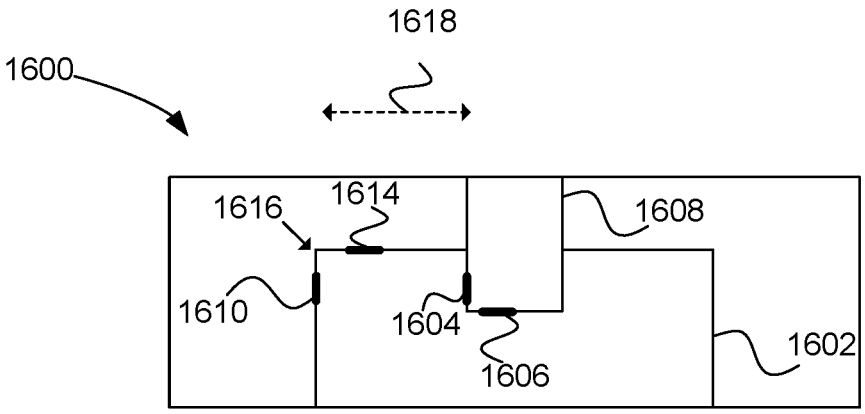
Figure 17:
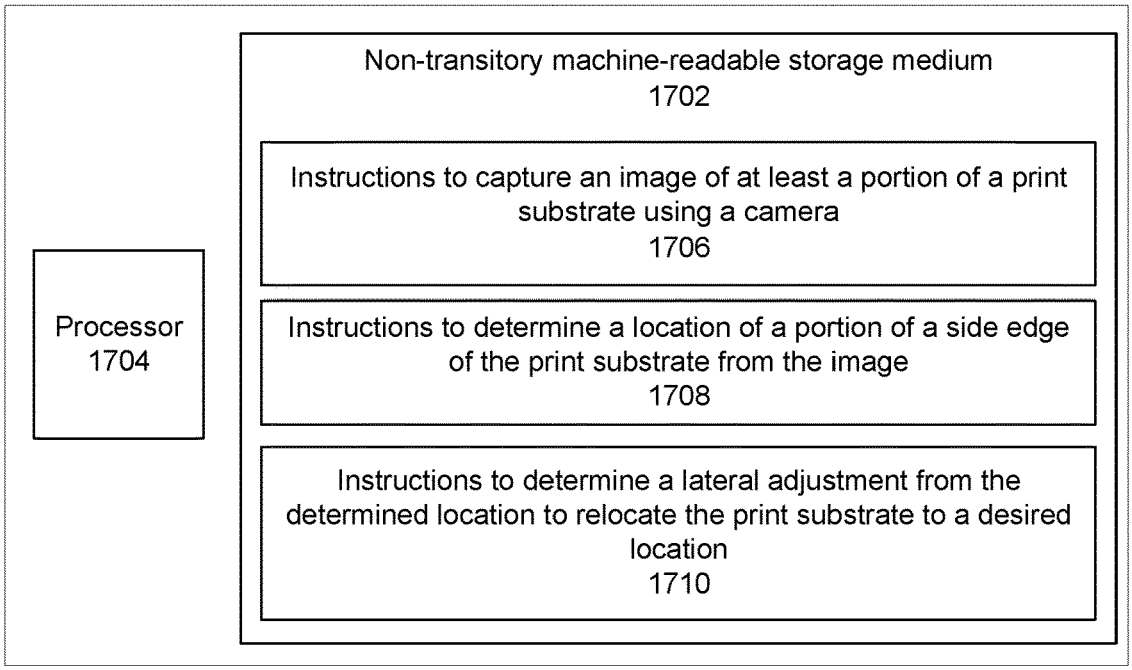
Figure 18:
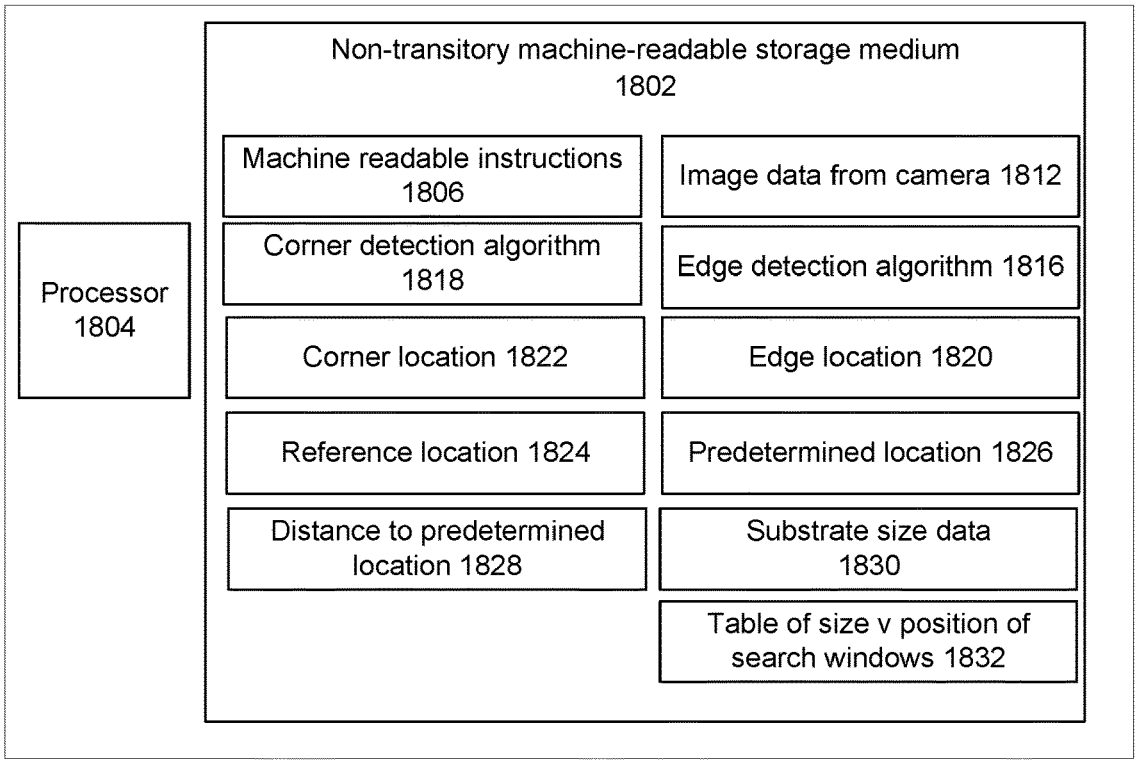

FIGS. 3A and 3B provide example schematic diagrams of an adjustment of a print substrate;

FIG. 4 provides an example of analysis of an image captured by a camera of the apparatus of FIG. 1 or 2;

FIGS. 5A, 5B and 5C provide other example schematic diagrams of an adjustment of a print substrate;

FIG. 6 provides another example of analysis of an image captured by a camera of the apparatus of FIG. 1 or 2;

FIG. 7 is an example flowchart of a method of transferring and adjusting the location of a print substrate in a printing device;

FIGS. 8A to 8H provide a series of example schematic diagrams for illustrating the method of FIG. 7;

FIG. 9 is an example flowchart of a method of adjusting the location of a substrate in a printing device;

FIG. 10 is a more detailed example flowchart of parts of a method of FIG. 9;

FIG. 11 is another more detailed example flowchart of the parts of the method of FIG. 9;

FIG. 12 is an example flowchart of a method of detecting and determining a location of a portion of a boundary of a substrate from an image;

FIGS. 13A, 13B and 13C are example illustrations of search windows which may be used in the method of FIG. 12;

FIG. 14 is a schematic diagram of an apparatus according to an example;

FIGS. 15 and 16 provide other examples of analysis of an image captured by a camera of the apparatus described; and FIGS. 17 and 18 are example schematic diagrams illustrating the components of a storage medium accessible by a processor which may be included in the apparatus described.

DETAILED DESCRIPTION

FIG. 1 is a schematic diagram illustrating an example apparatus 100 to implement examples described herein. The apparatus 100 may be a printing device. The apparatus 100 comprises a camera 102 to capture an image of at least a portion of a print substrate. The apparatus 100 also comprises a controller 104 to determine a location of a portion of a side edge of the substrate from the image to determine a distance of the print substrate from a predetermined location. Moreover, the apparatus 100 comprises adjustment apparatus 106 to adjust the entire substrate laterally, relative to the direction of transport of the substrate, based on the determined location. It will be appreciated that the printing device may also comprise additional components, as will be described for example with respect to FIG. 2 below.

In an example, the camera 102 may be a digital camera configured to capture two-dimensional (2D) images as digital files to be stored. The images produced by the camera may be black and white or in colour. The images are analysed to find the location of the print substrate.

The controller may comprise data processing apparatus which comprise, or otherwise have access to, memory for storing instructions and data for determining the location of the portion of the side edge. In an example, the controller 104 may be directly or indirectly connected to the camera 102. The controller 104 may communicate with the camera 102. In one example, the camera 102 may send the digital file of the captured image to the controller 104. The controller 104 may analyse the image to find the location of a portion of the side edge. More information about how the location of the portion of a side edge and the distance between that location and the desired predetermined location are determined will be described in more detail below.

In one example, the controller 104 may control the time that the camera 102 captures the image. The controller 104 may control the camera 102 to capture an image at a specific predetermined time or it may repeatedly capture images at a predetermined time interval. In an example, the controller 104 may control the time interval. In an example, the controller 104 may control the time that the camera 102 captures the image based on sensor information from a sensor connected to the controller 104. The sensor may detect a print substrate and inform the controller 104 such that the controller 104 can then control the camera 102 to capture an image of the print substrate. Alternatively, the camera 102 may be a video camera that is configured to sense the presence of a print substrate and captures an image when a print substrate is present. The controller 104 may also control the positioning of the camera 102, for example, the tilt, height or location of the camera 102 relative to the print substrate.

In an example, the controller 104 may be directly or indirectly connected to the adjustment apparatus 106. The controller 104 may communicate with the adjustment apparatus 106. In an example, the controller 104 may send instructions to the adjustment apparatus 106 based on the information derived from the image. For example, the controller 104 may send instructions to various components of the adjustment apparatus 106 to allow the various components of the adjustment apparatus 106 to adjust the entire substrate laterally, relative to the direction of transport of the substrate, based on the determined location and the distance to the desired predetermined location.

Adjustment apparatus 106 may comprise nip rollers to move the sheet forward in the direction of travel. The use of nip rollers is described in more detail with respect to FIGS. 8A to 8H. The adjustment apparatus 106 may also comprise grippers that can move the substrate laterally. Alternatively or additionally, adjustment apparatus may include lateral nip rollers that can move the substrate laterally relative to direction of transport of the substrate. Nip rollers may disengage by separating to allow the print substrate to move freely. The adjustment apparatus 106 may also comprise motors to drive the nip rollers and grippers. However, it will be appreciated that nip rollers and grippers are just examples and the adjustment apparatus may comprise other mechanisms for moving the substrate.

The apparatus 100 of FIG. 1 can be used to adjust the print substrate laterally either before or after printing. FIG. 2 is a schematic diagram illustrating an example apparatus 200 to implement examples described herein in which the capture of the image and the lateral adjustment takes place before the print substrate is printed upon. The lateral adjustment may form part of a side registration process. Side registration can be considered the process for ensuring that any impression on a print substrate, for example printing liquid or embossing, occurs in the precise position as intended. By using the apparatus 100 of FIG. 1, the accuracy of the side registration can be improved.

The apparatus 200 comprises a camera 202, a controller 204 and an adjustment apparatus 204. The camera 202 may be the camera 102 of FIG. 1. The controller 204 may be the controller 104 of FIG. 1. The adjustment apparatus 206 may be the adjustment apparatus 106 of FIG. 1. The apparatus 200 further comprises substrate feed apparatus 208 and print apparatus 210. In the example of FIG. 2, the adjustment apparatus 206 is located between the feed apparatus 208 and print apparatus 210. Print substrates in the form of sheets may be initially stored in a feeder pile or may be transferred to the feeder pile from, for example, a cutting machine. The feed apparatus 208 feeds sheets from the feeder pile to the adjustment apparatus 206, in which their locations are adjusted to ensure the print occurs in the position intended, before they are moved to the print apparatus 210. In addition to adjusting the sheet laterally with respect to the direction of transport of the sheet, the adjustment apparatus 206 may also adjust the sheet to correct for skew, for example, by rotating the sheet. The adjustment apparatus 206 may correct for skew before it captures an image of the substrate and determines a lateral adjustment based on the image. In another example, the feed apparatus 208 may feed a substrate in the form of a web to the adjustment apparatus 206 for adjustment and the print apparatus 210 may print on a web. In some examples, the feeding apparatus 208 may comprise nip rollers for moving the substrate. In some examples, the print apparatus may comprise an impression cylinder.

In systems that include nip rollers, the nip rollers may continuously move such that, when a print substrate is incident on the nip rollers, the print substrate is moved forward in the direction of travel. Alternatively, the nip rollers may be activated when a print substrate is detected. The feed apparatus 208 may further comprises a sensor which may be used to detect the print substrate. The sensor may send a signal to a controller, such as controller 204, or a separate controller, and in response to a signal indicating that the sensor has detected the substrate, the controller can then activate the nip rollers. The nip rollers can move the substrate to grippers which can then be controlled to transfer the substrate to the impression cylinder. Depending on how the substrate is received by the nip rollers, the substrate may not arrive at the grippers at the precise location intended. The substrate may be misplaced in the lateral direction. Any correction for skew may misplace the substrate further in the lateral direction. Skew correction may occur by controlling the motors to operate the nip rollers at different speeds. For example, the motors may move a nip roller faster than another nip roller to move the front of the print substrate in a clockwise direction. Alternatively, one motor may be stopped while the other motor corrects skew. Such manipulation of the substrate may, in addition to correcting skew, move the substrate in the lateral direction away from the intended position. Additionally, the leading edge and side edges of the print substrate may not be exactly at right angles to each other and the sheet may not be exactly the correct size. For example, the print substrate may have been cut prior to registration and, due to tolerances on cutting edges, an error may exist. Such errors may also result in the print substrate not being in the intended position and/or making it more difficult to place it in its intended position.

To address these issues, various examples described in more detail below provide a system and a method to provide lateral adjustment of a print substrate based on a camera image. In some examples proper registration is provided by moving the entire substrate laterally to place it in its intended position. As will be described below, in some examples described herein side registration is carried out based on just the side edge. The location of the side edge is determined and the adjustment is made based on the location of the side edge. In other examples described herein, side registration is carried out based on a corner of the substrate. The location of the corner can be determined from the side edge and a leading edge, or otherwise, and the adjustment is made based on the location of the corner. In other words, in some examples, the adjustment is based on not just the side edge but also the leading edge. By using a camera, a more accurate adjustment can be made. Moreover, by making the adjustment based on a corner between the side edge and the leading edge, instead of just a side edge, the adjustment can be made even more accurate. It can overcome or reduce the error in side registration due to cutting tolerances. By capturing an image using a camera, more information is available for detecting and accurately determining the location of the side edge or corner and therefore achieve more accurate side registration. Moreover, imaging processing techniques such as, for example, subpixel rendering can be used to further improve resolution and further increase accuracy. The use of a camera can lower the overall front to front side registration error, as will be described in more detail with respect to FIGS. 3 to 6.

It should be readily apparent that the apparatus 100 and 200 of FIGS. 1 and 2 represent generalized illustrations and that other elements may be added or existing elements removed, modified or rearranged in some examples. Moreover, the locations and orders of the elements with respect to each other can be varied.

FIGS. 3A and 3B provide example schematic diagrams of an adjustment of a print substrate based on the location of a side or lateral edge of the print substrate. FIG. 3A schematically shows the relative locations of sheets 302 and 304 in the adjustment apparatus. FIG. 3B shows the relative locations of sheets 302 and 304 after side registration. It will be appreciated that, in practice, sheet 302 will have left the adjustment apparatus when sheet 304 enters and the sheets will be in the locations shown in FIGS. 3A and 3B at different times. An image of sheet 302 is taken in the adjustment apparatus and sheet 302 is aligned based on a distance between the side edge and a reference in the image captured by the camera. Sheet 304 enters the adjustment apparatus after sheet 302, a new image is taken of sheet 304, and sheet 304 is then aligned based on the distance between the side edge and a reference in the new image captured by the camera. The reference may correspond to a reference location in the printing device. As shown in FIG. 3B, after the lateral adjustment, sheets 302 and 304 are aligned with the side edges in the desired locations 306 for proper side registration. It will be appreciated that even if FIGS. 3A and 3B show the leading or front edge as the short edge of the rectangular substrate, in other examples, the substrate may be moving such that the leading edge is the long edge of a rectangular substrate.

FIG. 4 provides an example illustration of analysis of an image 400 captured by a camera of the printing device in order to adjust the location of the substrate based on the location of a side edge of the substrate as described with respect to FIGS. 3A and 3B. The camera captures an image 400 from above the sheet 402 and the sheet 402 is underneath a component of the printing device 404. The sheet 402 of FIG. 4 could be the sheet 302 or 304 in FIGS. 3A and 3B. The component of the printing device 404 includes a reference mark 408 and the reference mark 408 is detected by the controller. Additionally, the controller detects a portion of the side edge 410 of the sheet 402. The controller then determines the location of the portion of the side edge relative to the reference location. For example, in FIG. 4, the controller calculates a distance 412 between the location of the side edge 410 and the location of the reference mark 408. The controller knows the distances between the location of the reference mark 408 and an intended location of the side edge for proper side registration. The distance between the detected side edge 410 and the reference mark 408 can therefore be used to determine a distance between the side edge and the desired location of the side edge for proper side registration. The entire substrate can then be moved sideways based on this distance.

In FIG. 4, the reference mark 408 is a small circle of a contrasting shade or colour from the component of the printing device that it is located on such that it is easy to detect within the image. In other examples, the reference mark 408 may be a differently shaped mark such as a square or rectangle. In yet other examples, the reference mark 408 may be an edge or other characteristic of the component of the printing device 404 or image, as will be described in more detail below, for example, with respect to FIGS. 15 and 16. The reference mark corresponds to a known location in the printing device. The component of the printing device used as the reference mark, or on which the reference mark is placed, may be a piece of equipment used during the adjustment or printing process, for example, the component may be a gripper. For the sake of simplicity, FIG. 4 shows a single gripper but the adjustment apparatus may include a plurality of grippers for gripping the substrate and the reference mark may be provided on one of them.

By determining the location of the side edge relative to a reference in the actual image corresponding to a known location in the printing device, the exact location of the camera is less significant and an accurate location of the side edge can be found without calibrating the camera.

FIGS. 5A, 5B and 5C provide example schematic diagrams of an adjustment of a print substrate based on the location of the corner between the side edge and the leading or front edge of the substrate. In reality, sheets are rarely of exactly the same shape, as shown in FIGS. 3A and 3B. The edges of the substrates are rarely exactly perpendicular. Instead, due to substrate cutting tolerances, different sheets may have slightly different shapes. Consequently, by aligning them based on just the side edge, small alignment errors may still occur. FIGS. 5A, 5B and 5C show how the alignment error due to cutting tolerance can be further reduced.

FIG. 5A schematically shows the relative locations of sheets 502 and 504 in the adjustment apparatus. FIG. 5B shows the relative locations of sheets 502 and 504 after side registration if the side registration is based on the location of just the side edge. FIG. 5C shows the relative locations of sheets 502 and 504 after side registration based on the location of the corner of the substrate. It will be appreciated that, in practice, sheet 502 will have left the adjustment apparatus when sheet 504 enters and the substrates will be in the locations shown in FIGS. 5A, 5B and 5C at different times.

Sheets 502 and 504 are not exactly the same shape. However, it will be appreciated that the difference in shape is exaggerated in FIGS. 5A to 5C and 6 for the sake of clarity. An image of sheet 502 is taken in the adjustment apparatus and the location of the sheet 502 is adjusted based on the image. Sheet 504 enters the adjustment apparatus after sheet 502, a new image is taken of sheet 504, and sheet 504 is then aligned. The locations of the substrates are adjusted based on information in the images, including the location of the side edges of the substrates. The arrows in FIGS. 5A, 5B and 5C indicate where the side edges of the sheets are detected and therefore the portions of the side edge for which locations are determined. It will of course be appreciated that in other examples the side edge portions may be located closer or further away from the corners. FIG. 5B illustrates the positioning of sheet 504 relative to sheet 502 after lateral adjustment based on the side edge rather than the corner. The sheet 504 of FIG. 5B has been aligned based on the distance between the detected side edge portion and a reference in the new image captured by the camera. As can be appreciated from FIG. 5B, if the documents do not have the same shape, the corners between the side edges and the leading edges of the two sheets may not be moved to the same position. If the printing process assumes that each substrate is located such that the corner between the leading edge and the side edge is in a precise intended position, which is the case in many printing systems, the location of the impressions on the two sheets will not be the same. In FIG. 5C, the sheets are repositioned based on the corner instead of based on just the side edge. The controller controls the adjustment apparatus to adjust the entire first sheet 502 such that the corner of the first sheet is relocated to a predetermined location 506 and to adjust the subsequent second sheet 504 such that the corresponding corner of the second sheet is relocated to the same predetermined location 506. As can be seen from FIG. 5C, when the lateral adjustment is determined based on the location of the corner, more accurate alignment of the sheets is obtained.

FIG. 6 provides another example of analysis of an image 600 captured by a camera of the printing device to illustrate how the location of the corner can be determined. As shown in FIG. 6, the camera has captured an image 600 from above the sheet 602 and the sheet 602 is underneath a component of the printing device 604. The sheet 602 of FIG. 6 could be the sheet 502 or 504 in FIGS. 5A and 5B. The component of the printing device 604 may be a gripper and the reference mark 608 may be a reference mark on the gripper as described with respect to FIG. 4. The controller detects the reference mark 608. Additionally, the controller detects a portion of the side edge 610 and a portion of the leading edge 614 of the sheet 602 and determines the location and orientation of the side edge 610 and the leading edge 614 relative to the location of the reference. The controller can then extrapolate using the location and orientation of the portions of the leading edge and the side edge to determine a location of a corner 616 of the substrate. The distance in the x direction 618 between the corner and the reference can be found. The location of the corner can then be used to determine the lateral offset between the actual location of the corner of the sheet and the desired location of the corner and the lateral adjustment of the sheet 602 for proper side registration.

FIG. 7 is an example flowchart of a method 700 of adjusting a print substrate. FIGS. 8A to 8H provide a series of example schematic diagrams further illustrating the method 700 of FIG. 7. The schematic diagrams of FIG. 8A to 8H show a side view of an apparatus 800 for adjusting the print substrate according to an example. FIG. 8A illustrates the apparatus without a print substrate. The apparatus comprises nip rollers 804, grippers 806 located on an arm and an impression cylinder 802. The grippers 806 may be located both above and below the print substrate such that when they are closed the print substrate is held by the grippers. The apparatus 800 also comprises a sensor 810 for detecting the print substrate, a sensor 812 for detecting skew and a camera 814 for capturing an image of the print substrate. The grippers and at least some of the nip rollers may form part of the adjustment apparatus 106 or 206 of FIGS. 1 and 2. Some of the nip rollers may form part of the feed apparatus 208 of FIG. 2. The impression cylinder may form part of the print apparatus 210 of FIG. 2.

Figure 8:
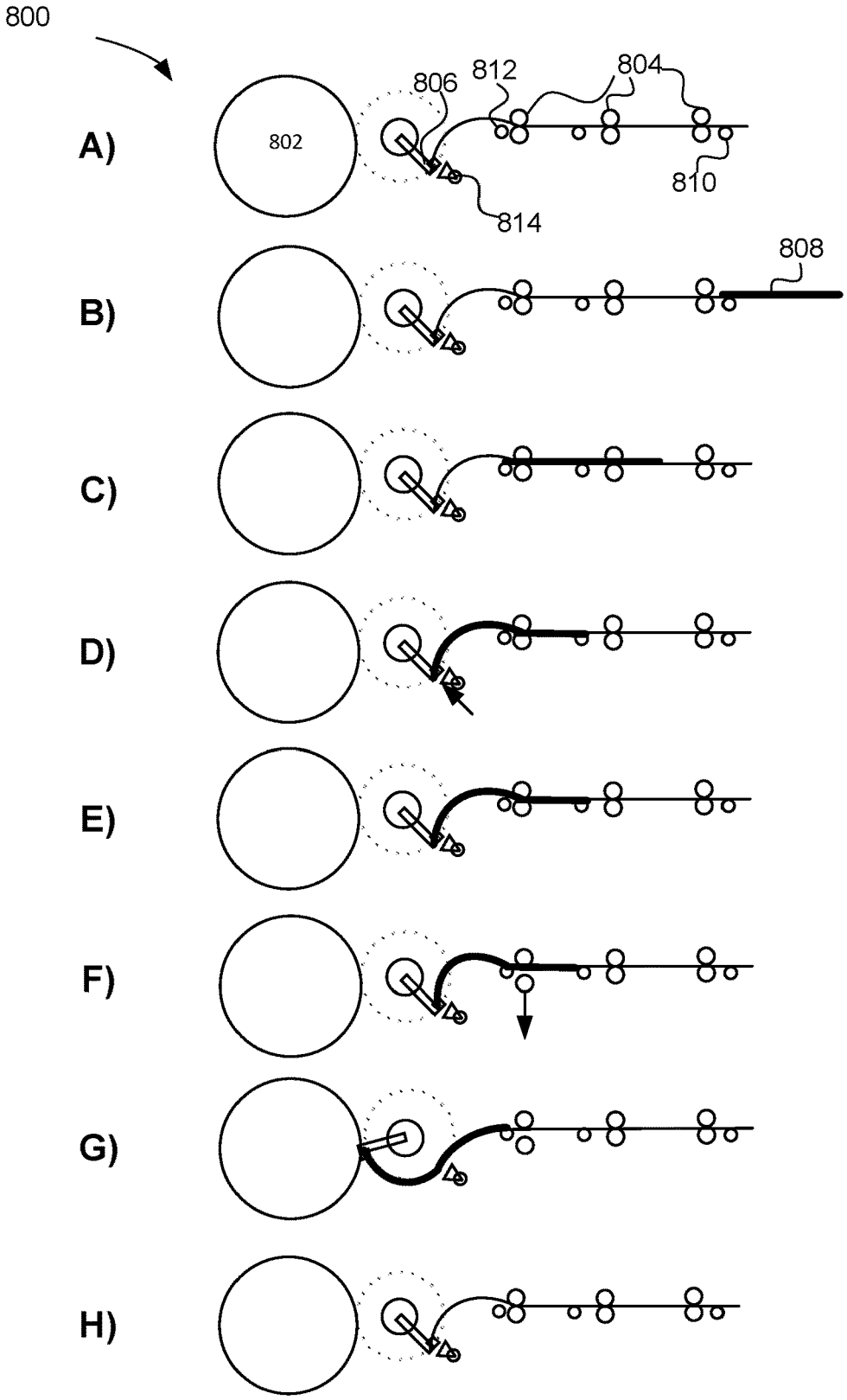

With respect to FIGS. 7 and 8, firstly, a print substrate 808 is detected, at 702. As shown in FIG. 8B, sensor 810 may detect the print substrate 808. The skew of the print substrate may then be measured by the skew sensor 812. As shown in FIG. 8C, the skew sensor 812 may measure the skew of the print substrate 808, at 704. The printing device then adjusts the print substrate 808 to correct for skew based on the sensor measurements, at 706. The adjustment to correct skew may be a rotation of the print substrate 808. For example, nip rollers may rotate to transport the print substrate 808 forward and, for skew correction, the front edge may be driven into a barrier for frontal alignment. In more detail, when a portion of the leading edge of the print substrate 808 is incident on the barrier, some nip rollers may continue to move while others are held still to rotate the substrate to drive more of the leading edge against the barrier. The barrier (not shown in FIGS. 8A to 8H) may be formed by the grippers. After skew has been corrected, the printing device performs side registration, at 708. FIG. 8D illustrates the grippers 806 closing such that it grips the print substrate 808. The print substrate is also gripped by the nip rollers closest to the grippers. While the print substrate is held still, the camera 814 then captures the image of at least a portion of the print substrate in FIG. 8E. The nip rollers 804 gripping the substrate then disengage to release the print substrate to allow the print substrate to move, as shown in FIG. 8F. Once the nip rollers 804 are disengaged, the grippers 806 adjust the entire substrate laterally based on the captured image. The aligned print substrate is then fed, at 710, into the impression cylinder 802. This may be achieved by the grippers rotating the print substrate 808 to provide the print substrate 808 to the impression cylinder 802 as illustrated in FIG. 8G. FIG. 8H shows the system reset and ready for receiving another print substrate.

Apparatus 800 of FIGS. 8A to 8H is an example apparatus and some elements within the apparatus may be removed or replaced with other elements and the order that the elements appear may change. For example, the sensor used to measure the skew may be the same or a different sensor to that used to detect the print substrate. Moreover, either sensor may be placed on or next to the nip rollers. A single pair or a plurality of pairs of nip rollers may grip the print substrate and then disengage to release the print substrate and the number of nip rollers used to grip the print substrate may be dependent on the distance between the nip rollers and on the size and shape of the substrate. In an example, instead of being fed into the impression cylinder, the aligned print substrate can be fed into different types of print apparatus.

How side registration is performed at 708 of FIG. 7, in some examples, will now be described in more detail with respect to the example flowchart of a method 900 shown in FIG. 9. At 902, during registration of a print substrate in a printing device, an image of a portion of the substrate is captured using a camera. At 904, a location of a portion of a boundary of the substrate is then determined from the image. At 906, a distance of the location of the portion of the boundary from a desired location is determined. At 908, the entire substrate is adjusted laterally based on the determined distance to relocate the substrate such that the portion of the boundary is in the desired location. The portion of a boundary may be a portion of a side edge of the substrate. Further, it may be the corner of the substrate.

The determining 904 of the location of a portion of a boundary of the substrate from the image and the determining 906 of the distance between the boundary and the desired location will be described in detail below in relation to FIGS. 10 and 11. The adjusting 908 of the entire substrate has been described above in relation to the adjustment apparatus of FIG. 1.

FIG. 10 is an example flowchart of a method 1000 of determining a location of a portion of a boundary of a substrate from an image and determining a distance between the boundary and an intended location of the boundary of the substrate. In the example of FIG. 10, the portion of a boundary is a portion of a side edge of the substrate. In an example, method 1000 is performed by the controller. At 1002, the side edge is detected. The side edge may be detected by detecting contrasts in colours or greyscale within the captured image. Side edge detection will be explained in more detail in relation to FIG. 12. At 1004, a reference in the image, corresponding to a known location in the printing device, is detected. The reference in the image may, for example, be a circular reference as described with respect to FIGS. 4 and 6 or another reference as described previously in relation to these Figures. The reference may also be detected by detecting contrasts in colours or greyscale within the captured image. The side edge and the reference detection may be carried out in parallel. At 1006, the location of the side edge as a location relative to the reference is then determined. The location of the whole side edge may not be determined. The location of a portion of the side edge is determined and it is assumed that the location of the portion is indicative of the location of the whole side edge. However, in some examples the portion of the side edge may be a portion corresponding to the whole side edge. In more detail, the location of the portion of the side edge may be determined by applying an x-y coordinate system, in which the x direction is perpendicular to the direction of travel of the substrate, to the image and measuring the distance x1 in the x-direction between one point of the portion of the side edge and the reference. At 1008, the distance between the portion of the side edge and the desired location of the side edge is then determined. For example, if the intended location of the side edge, for proper side registration, is a distance x2 from the known location corresponding to the reference, the x offset between the portion of the side edge and the desired location can be calculated as the difference between x2 and x1. This distance, x2−x1, is then used as an adjustment value to control the adjustment apparatus to adjust the entire substrate laterally to its intended location.

As FIG. 10 is an example flowchart, elements may be reordered and elements may also be added or removed. For example, although the side edge and reference detections are shown to be carried out in parallel, they may be carried out in series. The reference may be located before or after the side edge is detected.

FIG. 11 is another example flowchart of a method 1100 of determining a location of a portion of a boundary of a substrate from an image and determining a lateral adjustment to relocate the substrate. In the example of FIG. 11, the portion of the boundary is a corner of the substrate. In an example, the method 1100 is performed by the controller. At 1102, the side edge is detected and, at 1104, the leading edge is detected. The edges may be detected by detecting contrasts in colours or greyscale within the captured image. Edge detection will be explained in more detail in relation to FIG. 12. At 1106, the reference in the image, corresponding to a known location in the printing device, is detected. As in FIG. 10, the reference in the image may, for example, be a circular reference as described with respect to FIGS. 4 and 6. The edge detection and reference detection may be carried out in parallel. At 1108 and 1110, the location of the side edge and the location of the leading edge, as locations relative to the reference, are then determined. The location of the whole edges may not be determined. The location of a portion of the side edge and a location of a portion of the leading edge may be determined and it is assumed that the locations of the portions are indicative of the locations of the whole edges. However, in some examples the portion of the edge may be a portion corresponding to the whole edge. The orientation of the portions of the edges are also determined at 1108 and 1110. Briefly, for example, an x-y coordinate system, in which the x direction is perpendicular to the direction of travel of the substrate, may be applied to the image and the coordinates and slope of the edges may be determined with respect to that coordinate system. The determination of the location and orientation of the side edge may be carried out in parallel with the determination of the location and orientation of the leading edge. How the location and orientation are determined will be explained in more detail with respect to FIG. 12 below. At 1112, by extrapolating from the locations of the side and leading edges, the location of the corner of the print substrate relative to the reference can be obtained. The extrapolations from the corners may be carried out using the determined orientations of the edges. Starting from the coordinates of points on the edges, the slops of the lines corresponding to the edges can be used to determine where the lines intersect and therefore where the corner is located. Using the coordinate system mentioned above, the location of the corner may be determined as the distance x3 in the x direction from the reference. Alternatively, both the x and y coordinate of the corner in a coordinate system mentioned above can be determined and stored. Since the reference corresponds to a known physical location, the distance between the reference and the desired location of the corner for accurate printing is known, and, at 1114, the distance between the actual location of the corner and the desired location of the corner is determined. For example, if the intended location of the corner, for proper side registration, is a distance x4 in the x direction from the known location corresponding to the reference, the distance from the corner to the desired location can be calculated as the difference between x4 and x3. This distance, x4−x3, can then be used as an adjustment value to adjust the entire substrate, transversely to the process direction of the substrate, to a desired location.

As FIG. 11 is an example flowchart, elements may be reordered and elements may also be added or removed. For example, although the side edge, leading edge and reference detections are shown to be carried out in parallel, they may be carried out in series in any order. Similarly, although the determinations of the location and orientation of the edges are shown to be carried out in parallel, they may be carried out in series in any order. Moreover, in some examples, the orientations of one or both of the edges may already be known and may not be determined.

The flowchart of FIG. 12 provides a method 1200 of detecting and determining the location and orientation of a high-contrast feature of a substrate, such as a portion of a boundary of the substrate, from an image. It can be used, in some examples, to detect and determine the location and orientation of the side and/or leading edge in FIG. 11. Parts of the method may be used to detect and find the location of the side edge in FIG. 10. The method 1200 may be performed by a controller, for example the controller of FIG. 1 or 2. Method 1200 utilises search windows, for example the search windows that will be described with respect to FIGS. 13A to 13C. A plurality of search windows for use within an image may be stored in memory. The search windows may be used for detecting edges, each search window being associated with a respective substrate size. The controller may be coupled to a memory and can select a search window appropriate for a size of the substrate to detect a portion of an edge of the substrate. At 1204, a substrate size is determined. The determination of the substrate size may be made from sensors that detect the size of the print substrate or from the default or chosen settings sent to the controller. For example, in the apparatus of FIG. 2, the feed apparatus 208 may have knowledge of the substrate size and send this to the controller. Alternatively, the print apparatus 210 may have knowledge of the substrate size because it may be commanded to print on a certain document size and therefore the print apparatus may send the document size to the controller. At 1206, based on the determined substrate size and the feature to be detected, the appropriate search window is selected. For example, if the feature is a side edge, the appropriate window would be a window covering an area in which the side edge is expected to be located. In an example, the controller may access a table of search windows and substrate sizes in memory to select the appropriate window. At 1208, the window is searched to detect an area of high contrast. In more detail, for example, the controller may scan the pixels of the search window from one side to the other to find the area of high contrast. At 1210, an area of high contrast, in the form of a line, is found.

At 1212, the coordinates of each side of the high-contrast line, where the line intersects the edges of the window are determined. The coordinates of the line may be determined with respect to the reference in the image. For example, an x-y coordinate system, where the x-direction is perpendicular to the direction of travel of the substrate, may be applied to the image. The origin of the coordinate system may coincide with the location of the reference. The distance in the x-direction and the distance in the y-direction from the reference may then be determined for each point where the line of high contrast intersects with the search window. At 1214, the gradient of the line is then determined, for example, from the two sets of coordinates. The line may then be expressed as the two coordinates of one of the points where the area of high contrast crosses the edge of the search window, and an equation representing the slope of the line in the coordinate system. In this example, the coordinates would then correspond to the location of the edge and the equation would correspond to the orientation of the edge. At 1218, the controller then stores the coordinates and the equation of the line of high contrast. The coordinates and the equations can later be used to find the corner between the edges by extrapolation. Since the reference in the image is used to determine the location and orientation of the area of high contrast, the controller may wait to proceed with the location and orientation determination part of the method until the reference has also been detected if the reference detection has not been done before or in parallel with the edge detection.

The method may then be repeated for the leading edge. Of course, the size of the substrate may already be known so this may not need to be determined again. In some examples, the orientation may not be determined for the leading edge because it may already be known. If skew has already been corrected, frontal alignment may have been achieved and the leading edge may have been moved into an orientation perpendicular or substantially perpendicular to the direction of travel. Consequently, the x coordinates of both points of the line of the leading edge will be, or will be assumed to be, the same. In other examples, when, for example, skew has not been corrected or if any tolerance in the skew correction is to be compensated for when finding the corner, the orientation of the leading edge is determined as well as the location.

As FIG. 12 is an example flowchart, elements may be reordered and elements may also be added or removed. In some examples, the method of FIG. 12 may be modified and the controller may select a default window without finding document size and then iteratively move the window until an area of high contrast is found. In some examples, a single search window suitable for all document sizes may be used. By using search windows, the number of pixels that are analysed to find the edges, and therefore the time to detect and determine the location of the edges, can be reduced. In other words, by using search windows, the edge detection process can be made more efficient.

The method of FIG. 12 is illustrated further with respect to FIGS. 13A to 13C, which show examples of search window positioning. The feature to be detected in the image 1300 of FIG. 13A is the side edge of the print substrate 1302 and a search window 1304 has been selected such that it covers an area of the image in which the side edge of the print substrate 1302 is expected to be for the determined size of the print substrate 1302. FIG. 13A also shows a second search window 1306 which could have been selected for a smaller print substrate. For example, in FIG. 13A, the substrate size may be determined to be a large document, for example A3 size. The second search window could instead have been used if the substrate had been an A4 document. If the lateral adjustment is made based on the side edge rather than the corner between the side edge and the leading edge, a search window for the leading edge is not used. Moreover, the method may not include the determination of the orientation of the line corresponding to the side edge. In some examples, the x coordinate of just one of the two points of intersection between the area of high contrast and the search window edge may be determined in that case and that coordinate may then be stored as the location of the side edge.

FIG. 13B is an example of the positioning of two search windows with respect to an image 1310 in order to find a corner of a print substrate 1312. A first search window 1314 is positioned over an area of the image in which the side edge of the print substrate 1312 is expected to be located and a second search window 1316 is positioned over an area of the image in which the leading edge is expected to be located. Using these search windows, the controller can then find the corner between the leading edge and the side edge as described above in relation to FIG. 11. FIG. 13B also shows third and fourth search windows 1318, 1320 which could have been selected for a smaller print substrate. As is shown in FIG. 13B since the document photographed is large, the selected search windows 1314, 1316 may be positioned further from the centre of the image than if the document had been a smaller document. Although windows for two different sized documents are illustrated with respect to FIGS. 13A and 13B, the printing device may use a large number of possible search windows for a large number of substrate sizes. Alternatively, in some examples, a single search window for the side edge and/or a single search window for the leading edge may be provided. The coordinates of the search window may be selected so that it is appropriate for a large number of substrate sizes. The locations and sizes of the search windows shown in FIGS. 13A to 13C are examples and other locations and sizes of search windows can be used. FIG. 13A to 13C show large windows for the sake of clarity. In some examples, small search windows located close to the corner may allow efficient and accurate determination of the location of the edges and the location of the corner. The size of the windows may be selected to be large enough to detect the edges but still small enough to reduce the number of pixels to be scanned and ensure efficient processing of the image data.

The same search window may be used to detect both an edge and a reference mark in the image. FIG. 13C illustrates an example of the positioning of a search window over an image 1320 for detecting both a leading edge of a print substrate 1322 and a reference on a gripper. FIG. 13C shows a first window 1324 for detecting the side edge and a second window 1326 for detecting the leading edge and a reference on a gripper 1328. The second search window 1326 is, in addition to being over an area in which the leading edge is expected to be located, also over the location of the gripper 1328 with the reference. The controller may then look for two areas of high contrast. If, for example, the reference is a circular mark, the controller will be able to distinguish between the leading edge and the reference although they are in the same search window. The reference does not have to be a circular mark. It could alternatively be a mark or a physical characteristic of the gripper that can be distinguished from the leading edge, for example a mark or a characteristic with another shape or at least a sufficiently different orientation to the leading edge. As shown in FIG. 13C, the adjustment apparatus may comprise a plurality of grippers but the window may just cover the area in which the gripper that provides the reference is located.

FIG. 14 is a schematic diagram of a side view of an apparatus 1400 according to a specific example, which may be used with the example apparatus and methods described above. Print substrate 1408 is moving forward in the direction of the arrow. The print substrate is moving towards a gripper 1410 on an arm, which also forms a stopper 1412 for front alignment of the document. The camera 1414 may be positioned above the face of the substrate such that it captures an image of the portion of the substrate. Reference mark 1416 may be positioned on top of the gripper, visible to the camera, 1414. The apparatus may also comprise a side movement motor 1418 for driving the gripper to adjust the location of the sheet.

As mentioned above, in some examples the reference may not be a reference mark on a gripper. It can be a reference mark on another component of the print device or a physical characteristic of a component of the printing device. As yet another alternative, the reference could be the corner of the image instead of a mark or characteristic of a component of the printing device. The image may include more than one reference and the location of the side and leading edges may be determined with respect to different references. FIGS. 15 and 16 are schematic diagrams illustrating how the location of a side edge can be determined when the reference is a physical characteristic of the adjustment apparatus. FIG. 15 illustrates an image 1500 for detecting just a side edge and FIG. 16 illustrates an image 1600 for detecting both a side edge and a leading edge to allow the location of a corner to be found by extrapolation. As can be seen in FIG. 15, from the image of the substrate 1502, a side edge 1504 of a gripper 1506 has been detected together with a side edge 1508 of the substrate. An x-y coordinate system with an origin corresponding to a point of the gripper, for example a point on the side edge of the gripper where an edge of a search window intersects the edge of the gripper, may be applied to the image. The location of the portion of the side edge 1508 can then be determined with respect to the location of the side edge 1504 of the gripper. For example, the location can be determined by measuring the distance 1510 in the x direction between the two edges.

As can be seen in FIG. 16, from the image 1600 of the substrate 1602, first and second edges 1604 and 1606 of a gripper 1608 have been detected together with a side edge 1610 and a leading edge 1614 of the substrate. An x-y coordinate system with an origin corresponding to a point on the gripper, for example a point on one of the edges, may be applied to the image. The edges of the gripper would have known coordinates in the coordinate system since the relative locations of the two edges of the gripper are known. The location and orientation of the portion of the side edge 1610 can then be determined with respect to the location and orientation of a first edge 1604 of the gripper corresponding to the side edge of the gripper. The location and orientation of the portion of the leading edge 1610 can be determined with respect to the location and orientation of the other edge 1606 of the gripper. By extrapolating from the side edges of the substrate, the location of the corner 1616 and the distance 1618 in the x direction from the corner to a point on the gripper with a known location can then be found.

When the reference is a mark on a component of the printing device or a physical portion of such a component, the known location, corresponding to the reference, is not dependent on the exact location of the camera. As a result, accurate lateral adjustment does not dependent on correct calibration of the camera and the camera can be placed in the device without calibration.

The methods described above may be computer-implemented. FIG. 17 illustrates a non-transitory machine-readable storage medium 1702 accessible by a processor 1704 to carry out the above described method according to an example. The processor and the machine-readable storage medium may form part of the controller described above with respect to, for example, FIGS. 1 and 2. The non-transitory machine readable storage medium 1702 is encoded with instructions that are executable by the processor 1704. The instructions comprise instructions 1706 to capture, in a printing device, an image of at least a portion of the print substrate using a camera. The instructions also comprise instructions 1708 to determine a location of a portion of a side edge of the print substrate from the image. Furthermore, the instructions also comprise instructions 1710 to determine a lateral adjustment, relative to a direction of transport of the substrate, from the determined location to relocate the print substrate to a desired location. The storage medium may include any combination of suitable volatile memory and/or non-volatile memory, including, but not limited to, read-only memory (ROM), random access memory, cache, buffers, etc. Although a single processor is shown, the storage medium may be shared among various processors or dedicated to particular processors. The storage medium may also comprise additional instructions and data for carrying out the method described.

FIG. 18 shows another example of a non-transitory machine readable storage medium 1802, accessible by a processor 1804 for implementing the methods described above, comprising additional data and instructions. Non-transitory machine readable storage medium 1802 is encoded with instructions that are executable by the processor 1804. The storage medium may be the storage medium of FIG. 17 but, in addition to instructions 1806 corresponding to the instructions described with respect to FIG. 17, the non-transitory machine readable storage medium 1802 may also comprise, for example, instructions to determine an orientation of the portion of a side edge, instructions to determine a location of a leading edge and instructions to extrapolate from the location and orientation of the portion of the side edge and the location and an orientation of the leading edge to determine a location of a corner of the substrate. As mentioned above, in some examples, the orientation of the leading edge may also be determined from the image and the storage medium may further comprise instructions for determining the orientation of the leading edge. In other examples, it may be assumed for the extrapolation that the leading edge is perpendicular to the direction of travel. The instructions to determine a lateral adjustment may comprise instructions to determine a lateral adjustment, from the determined location of the corner, to relocate the substrate such that the corner is in a desired location.

The non-transitory machine readable storage medium 1804 may further comprise a storage area for storing image data 1812 captured by the camera. The processor would then access this image data for analysis to determine the location of the substrate. The storage medium may further comprise algorithms for edge detection 1816 and corner detection 1818 as described herein, for example, with respect to FIGS. 10 to 12. It may further comprise a storage area for storing determined edge locations 1820. Additionally, it may comprise a storage area for storing corner locations 1822 in examples where the corner is determined. It may also store the reference location 1824 or a plurality of reference locations if a plurality of reference locations are used. Furthermore, it may also store the desired location 1826 of the edge or corner of the substrate relative to the reference such that an accurate lateral adjustment can be determined. Moreover, it may include a storage area 1828 for storing the calculated distance from the side edge, or corner, to the predetermined desired location. The storage medium 1802 may also store size data 1830 for the substrate and a table 1832 of sheet size, feature to be detected and the coordinates of suitable search windows. The controller can then search the table to select the correct window.

The storage medium may not store all the instructions and data described above and it may also store additional instructions and data.

The description of the various aspects and examples of the present disclosure has been presented for purposes of illustration and description, but is not intended to be exhaustive or to limit the disclosure to the forms disclosed. Any example of a feature or alternative described herein may be combined with any other example of a feature and alternative described, as appropriate, and the disclosure includes the various combinations and configurations of examples and alternatives.

As an example, it has been described that the corner of the substrate can be found from extrapolating from the side and leading edges. However, in some examples, the controller may find the corner from an image without using extrapolation from the edges. In other words, in some examples a relevant corner with respect to which the substrate can be aligned can be found without first determining the locations of the side edge and leading edge. Moreover, in some examples using a corner, depending on the set-up of the printing device, the corner may not be a corner between the leading edge and the side edge. Instead, the substrate may be aligned in the printing device based on a different corner of the substrate. Moreover, although an xy coordinate system, in which the x axis is perpendicular to the direction of travel, has been described as an example, any suitable coordinate system may be applied to the image in order to determine an appropriate lateral adjustment for the substrate.

Although a specific implementation of the adjustment apparatus comprising nip rollers and grippers have been described, the adjustment apparatus can also be implemented in other ways that allow the substrate to be adjusted laterally. For example, it may comprise a vacuum belt conveyer pushing in the lateral direction. Moreover, although the feed apparatus has been described to comprise nip rollers and the print apparatus has been described to comprise an impression cylinder in some examples, the apparatus may comprise additional or alternative components. For example, the print apparatus may comprise a photosensitive belt instead of a cylinder. It will be appreciated that the term printing device can comprise any 2D or 3D printing device, copier or multi-functional device.

The invention claimed is:

1. A printing device comprising:

a camera to capture an image of at least a portion of a print substrate;

a controller to determine, from the image, a location of a portion of a side edge of the print substrate, and determine a distance of the print substrate from a predetermined location; and an adjustment apparatus to adjust, based on the determined distance, the print substrate laterally relative to a direction of transport of the print substrate, wherein:

the adjustment apparatus comprises nip rollers and a gripper, the controller is to control the gripper and/or the nip rollers to hold the print substrate still while the camera captures the image, and control the nip rollers to release the print substrate to allow the gripper to adjust the print substrate laterally based on the determined distance, and the predetermined location is a location on the gripper.

2. The printing device of claim 1, wherein the controller is to determine a location of a corner of the print substrate from the image, and the adjustment apparatus is to adjust the print substrate based on the determined location of the corner.

3. The printing device of claim 2, wherein the controller is to determine a location of a portion of a leading edge of the substrate, and determine the location of the corner based on the location of the portion of the side edge and the location of the portion of the leading edge.

4. The printing device of claim 3, wherein the print substrate comprises a first sheet, and the controller is to:

control the adjustment apparatus to adjust the first sheet such that a corner of the first sheet is relocated to a predetermined location, and control the adjustment apparatus to subsequently adjust a second sheet such that a corresponding corner of the second sheet is relocated to the predetermined location.

5. The printing device of claim 3, wherein the controller further is to detect a reference in the image and to determine the location of the portion of the side edge and/or the location of the portion of the leading edge relative to the reference, the reference corresponding to a known location in the printing device.

6. The printing device of claim 1, further comprising feed apparatus and print apparatus, wherein the camera and the adjustment apparatus are located between the feed apparatus and the print apparatus.

7. The printing device of claim 1, further comprising a memory to store information defining a plurality of search windows within the image for detecting edges located within the plurality of search windows, each search window of the plurality of search windows being associated with a respective substrate size, wherein the controller is coupled to the memory to select a search window from the plurality of search windows based on a size of the print substrate, to detect the portion of the side edge.

8. The printing device of claim 1, wherein the controller is to control the nip rollers to rotate the print substrate to correct for a skew of the print substrate.

9. The printing device of claim 8, wherein the controller is to, after correcting for the skew of the print substrate, control the gripper to move laterally relative to the direction of transport of the print substrate, to adjust the print substrate laterally.

10. The printing device of claim 8, wherein the controller is to control the nip rollers to rotate the print substrate by continuing to move a first subset of the nip rollers while holding still a second subset of the nip rollers.

11. A method comprising:

capturing, using a camera during registration of a print substrate in a printing device, an image of a portion of the print substrate;

determining, from the image, a location of a portion of a boundary of the print substrate;

determining a distance of the location of the portion of the boundary from a reference location on a gripper of the printing device, the gripper to grip the print substrate; and adjusting, by controlling the gripper based on the determined distance, the print substrate laterally relative to a direction of transport of the print substrate, to register the print substrate relative to the reference location, wherein the portion of the boundary is a portion of a side edge or a corner of the print substrate.

12. The method of claim 11, wherein the determining of the location of the boundary of the print substrate comprises:

determining a location and an orientation of the portion of the side edge;

determining a location and an orientation of a portion of a leading edge of the print substrate; and extrapolating from the location and the orientation of the portion of the side edge and the location and the orientation of the leading edge to determine a location of the corner of the print substrate.

13. The method of claim 12, further comprising determining a size of the print substrate; and selecting, based on the determined size, a first search window and a second search window for detecting the portion of the side edge and the portion of the leading edge, respectively.

14. The method of claim 11, wherein the capturing of the image and the adjusting are performed before printing on the print substrate.

15. The method of claim 11, further comprising detecting the reference location within the image.

16. The method of claim 11, further comprising:

controlling, by a controller, the gripper and/or nip rollers to hold the print substrate still while the camera captures the image; and controlling, by the controller, the nip rollers to release the print substrate, while controlling the gripper to adjust the print substrate laterally relative to the direction of transport.

17. The method of claim 11, further comprising:

detecting a skew of the print substrate; and rotating the print substrate to correct for the skew of the print substrate, wherein the adjusting of the print substrate laterally is performed after the correcting for the skew.

18. A non-transitory machine-readable storage medium comprising instructions that upon execution cause a system to:

receive an image captured by a camera of at least a portion of a print substrate in a printing device;

determine a location of a portion of a side edge of the print substrate from the image;

detect, in the image, a reference location on a gripper in the printing device, the gripper to rig substrate; and determine a lateral adjustment, relative to a direction of transport of the print substrate, based on the determined location and the reference location, the lateral adjustment to relocate the print substrate to a target location using the gripper.

19. The non-transitory machine-readable storage medium of claim 18, wherein the instructions upon execution cause the system to:

determine an orientation of the portion of the side edge;

determine a location and an orientation of a portion of a leading edge of the print substrate; and extrapolate from the location and the orientation of the portion of the side edge and the location and the orientation of the portion of the leading edge a location of a corner of the print substrate, and wherein the instructions to determine the lateral adjustment comprise instructions to determine a lateral adjustment, from the determined location of the corner, to relocate the print substrate such that the corner is in a target location.

20. The non-transitory machine-readable storage medium of claim 18, wherein the instructions upon execution cause the system to;

control the gripper and/or nip rollers to hold the print substrate still while the camera captures the image; and control the nip rollers to release the print substrate, while controlling the gripper to adjust the print substrate laterally relative to the direction of transport.

* * * * *